US006254379B1

(12) United States Patent
Bool, III et al.

(10) Patent No.: US 6,254,379 B1
(45) Date of Patent: Jul. 3, 2001

(54) REAGENT DELIVERY SYSTEM

(75) Inventors: Lawrence E. Bool, III, Hopewell Junction; Hisashi Kobayashi, Putnam Valley, both of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/670,278

(22) Filed: Sep. 27, 2000

(51) Int. Cl.[7] ..... F23J 7/00

(52) U.S. Cl. ..... 431/4; 431/8; 431/181; 431/187

(58) Field of Search ..... 431/4, 5, 12, 8, 431/9, 181, 187, 158, 2, 10, 353; 239/424.5, 426

(56) References Cited

U.S. PATENT DOCUMENTS 5,100,313 * 3/1992 Anderson et al. ..... 431/8
5,814,125 * 9/1998 Anderson et al. ..... 75/414
5,823,762 * 10/1998 Anderson et al. ..... 431/8
5,954,855 * 9/1999 Gitman et al. ..... 75/10.42
6,096,261 * 8/2000 Anderson et al. ..... 266/225
6,139,310 * 11/2000 Mahoney et al. ..... 431/8
6,142,764 * 11/2000 Anderson et al. ..... 431/8

* cited by examiner

*Primary Examiner*—James C. Yeung
(74) *Attorney, Agent, or Firm*—Stanley Ktorides

(57) ABSTRACT

A method for providing reagent to a remote reaction zone wherein reagent preferably is mixed with carrier gas and maintained within the carrier gas as it is passed as a coherent jet through a distance to the reaction zone. The jet passes the leading edge of a confining flame envelope, loses its coherency and delivers the reagent to the reaction zone for reaction therein.

10 Claims, 1 Drawing Sheet

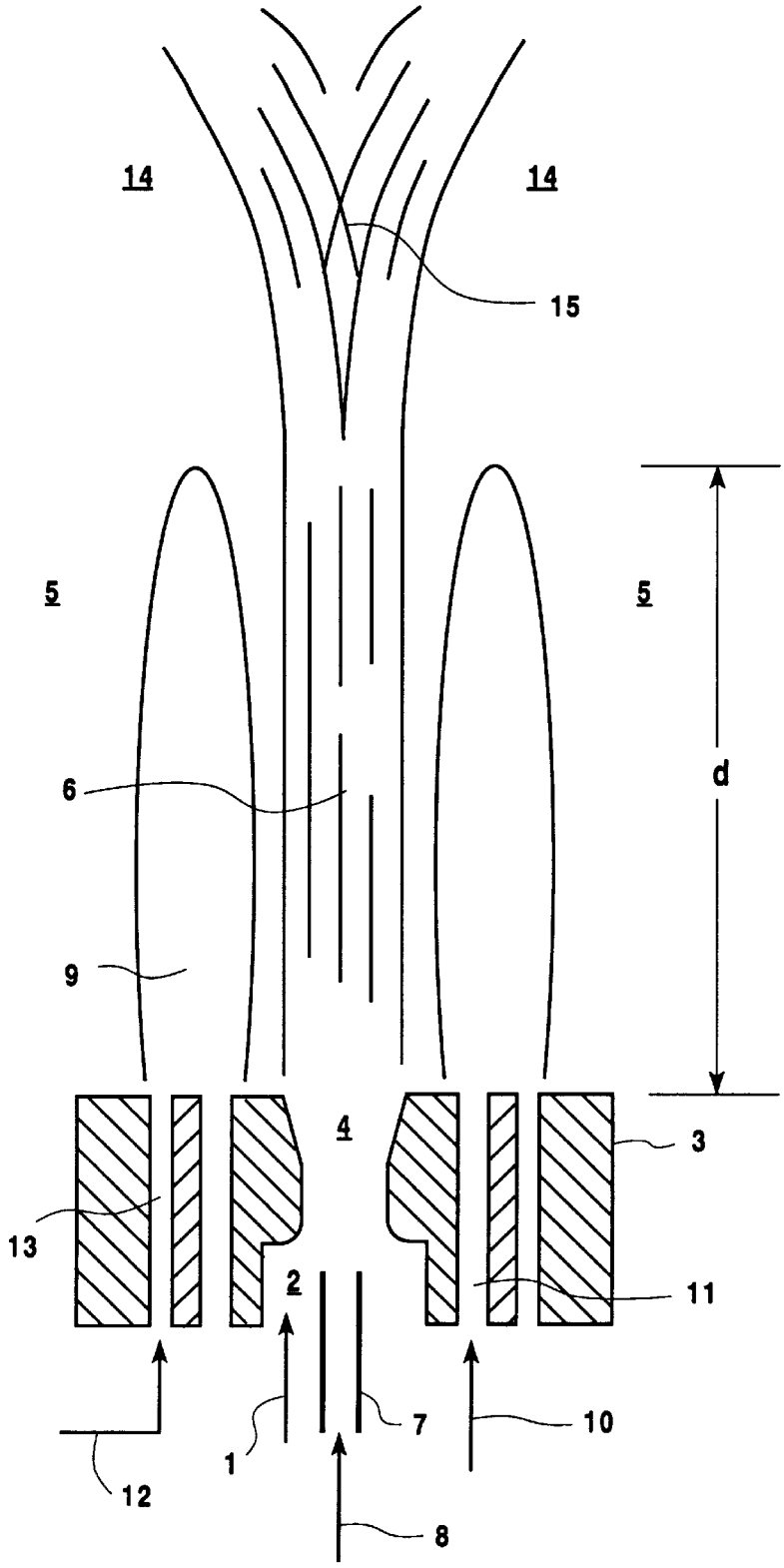
14
14
15
5
5
d
6
9
4
3
13
2
11
7
10
1
12
8

REAGENT DELIVERY SYSTEM

TECHNICAL FIELD

This invention relates generally to the delivery of reagent to a remote reaction zone, and is particularly useful for providing reagent to a remote reaction zone of a furnace for the conversion of nitrogen oxides (NOx) to nitrogen.

BACKGROUND ART

It is sometimes desired to provide reagent to a remote reaction zone such as at a specific location within the interior of a furnace. For example, in reburning wherein hydrocarbon radicals convert NOx to nitrogen gas for pollution control purposes, it is desired to provide hydrocarbon fuel such as natural gas or coal, which serves as a source of hydrocarbon radicals, to a remote area which contains flue gas. In another example it may be desired to provide ammonia or urea deep within a furnace to react with the NOx to form nitrogen gas.

One way to accomplish such reagent provision is to pass the reagent to the remote reaction zone using a long lance or other long provision means, but this is complicated to carry out and would require frequent replacement of the lance if the reaction zone were associated with a hot or corrosive environment such as a furnace. Another way to deliver reagents to a specific location in the boiler or furnace is to use. high velocity jets which typically penetrate deep into an enclosure before mixing is complete. However, this approach can lead to significant increases in the formation of pollutants in burners, such as NOx, and consumption of reagent prior to reaching the reaction zone. Both effects are due to the high entrainment rates characteristic of turbulent jets. Further, the high entrainment rates lead to recirculation of hot flue gas, which can contain particulate or corrosive gases, to the boiler or furnace wall, exacerbating deposition on the wall and corrosion. Yet another method is through the use of computational fluid dynamics modeling of a reaction zone such as a furnace environment. In this method detailed calculations are made to describe the furnace environment and nozzles or lances can then be placed in appropriate locations. This method can be effective but is quite complex to execute.

Accordingly, it is an object of this invention to provide a method whereby reagent may be provided to a reaction zone which is separated by a distance from the point where the reagent passes out from the injection device.

SUMMARY OF THE INVENTION

The above and other objects, which will become apparent to those skilled in the art upon a reading of this disclosure, are attained by the present invention one aspect of which is:

A method for providing a reagent to a reaction zone comprising:

(A) providing reagent to a carrier gas and passing reagent-containing carrier gas as a gas jet into an injection space from an injector through a distance (d);

(B) surrounding the gas jet with a flame envelope from the injector through the distance (d) so as to maintain the gas jet coherent through the distance (d);

(C) passing the reagent-containing carrier gas further into the injection space beyond the distance (d) into a reaction zone past the leading edge of the flame envelope as a non-coherent gas stream; and (D) providing reagent from the non-coherent gas stream to the reaction zone.

Another aspect of the invention is:

A method for providing a reagent to a reaction zone comprising:

(A) passing gaseous reagent as a gas jet into an injection space from an injector through a distance (d);

(B) surrounding the gas jet with a flame envelope from the injector through the distance (d) so as to maintain the gas jet coherent through the distance (d);

(C) passing the gaseous reagent further into the injection space beyond the distance (d) into a reaction zone past the leading edge of the flame envelope as a non-coherent gas stream; and (D) providing gaseous reagent from the non-coherent gas stream to the reaction zone.

As used herein the term "coherent gas jet" means a gas stream whose diameter undergoes no substantial increase along the length of the stream and the rate of entrainment of the surrounding gas into the gas stream is substantially less than that into a nonreacting turbulent jet.

As used herein the term "non-coherent gas stream" means a gas stream whose diameter increases as it entrains the surrounding gas.

As used herein the term "flame envelope" means an annular combusting stream coaxial with a gas stream.

As used herein the term "reagent" means a fuel or other chemical compound or mixture of compounds that takes part in a reaction after injection into an injection space.

BRIEF DESCRIPTION OF THE DRAWING

The sole FIGURE is a cross sectional representation of one preferred embodiment of the practice of the invention wherein reagent is provided to a carrier gas and then provided with the carrier gas to the reaction zone.

DETAILED DESCRIPTION

The invention will be described in detail with reference to the Drawing. Referring now to the FIGURE, carrier gas 1 is provided to central passageway 2 of injector 3 from a carrier gas source which is not shown. Any effective carrier gas may be used in the practice of this invention, examples of which include recirculated flue gas, oxygen, nitrogen, argon and air. Recirculated flue gas is particularly preferred as the carrier gas when NOx reduction is the aim of the invention. The carrier gas is passed from central passageway 2 to converging/diverging nozzle 4 and from there is passed out from nozzle 4 of injector 3 into injection space 5 as gas jet 6.

Reagent 8 is provided to the carrier gas. Preferably, as shown in the FIGURE, the reagent is provided to the carrier gas from reagent provision means 7 which communicates with a source of reagent (not shown) and which passes the reagent to nozzle 4 wherein it mixes with the carrier gas. The reagent may be in gaseous, solid or liquid form. Preferably the reagent is in liquid or particulate solid form and is atomized within the carrier gas stream as it passes through nozzle 4, thus being well mixed with the carrier gas within gas jet 6. Any effective reagent may be used in the practice of this invention, examples of which include one or more liquid hydrocarbons, powdered coal, ammonia and urea.

A flame envelope flows coaxially along and around gas jet 6 serving to maintain gas jet 6 as a coherent gas jet from injector 3 through a distance (d) within injection space 5. Preferably, as illustrated in the FIGURE, flame envelope 9 is formed by the combustion of separate oxidant and fuel streams provided into injection space 5 from injector 3 annular to coherent gas jet 6. In the embodiment illustrated in the FIGURE, fuel 10, such as natural gas, is provided to inner annular passageway 11 from a fuel source (not shown), and oxidant 12, such as air, oxygen-enriched air or pure oxygen, is provided to outer annular passageway 13 from an oxidant source (not shown). If desired, the oxidant for the flame envelope may be provided through the inner annular passageway and the fuel for the flame envelope may be provided through the outer annular passageway. This arrangement may be particularly useful if the carrier gas is an inert gas. The fuel and oxidant pass through their respective passageways and out from injector 3 into injection space 5 wherein they combust to form flame envelope 9 which flows coaxially with coherent gas jet 6 through distance (d).

In the practice of this invention the flame envelope forms a fluid shield or barrier around the gas jet 6. Preferably the flame envelope has a velocity which is less than the velocity of the gas jet. The fluid shield or barrier formed by the flame envelope around the gas jet greatly reduces the amount of ambient gases which are entrained into the gas jet, thereby serving to keep the jet coherent while it is housed within the flame envelope. This also serves to keep the reagent within the carrier gas jet while it is coherent.

Reaction zone 14 is within injection space 5 but remote from, i.e. not adjacent to, injector 3. In one embodiment of the invention, within reaction zone 14 there resides one or more species with which it is intended that reagent 8 react. For example, reaction zone 14 may contain one or more NOx species, such as nitrogen oxide (NO) or nitrogen dioxide ($NO_2$), with which the reagent may react to form nitrogen gas ($N_2$) thus serving pollution control purposes.

The reagent-containing gas stream passes beyond distance (d) further into injection space 5 past the leading edge of the flame envelope into reaction zone 14 as a non-coherent gas stream or turbulent jet 15. As the gas jet flows past the leading edge of the flame envelope, ambient gas is entrained into the gas jet causing it to become turbulent or otherwise lose its coherency. The reagent, e.g. liquid or solid particles, is kept within coherent gas stream 6 through distance (d), but as the carrier gas stream degrades into a non-coherent gas stream beyond the leading edge of flame envelope 9, the reagent particles gasify and disperse out from the carrier gas stream and react with the target specie (s), i.e. NOx, within the reaction zone. In this way reagent is effectively provided to a remote reaction zone, such as the central area of a furnace, without need for a long lance extending from the furnace wall to the reaction zone.

In another embodiment of the invention, the reagent is fuel such as powdered coal and the carrier gas is an oxidant such as air, and the reagent and carrier gas are delivered to the reaction zone where the resulting turbulence enables them to combust. In this way a combustion reaction is caused to occur in a specific location within a boiler or furnace away from the furnace wall. In this embodiment there is no significant combustion within the coherent gas jet 6 and the combustion occurs only after the reagent and carrier gas mixture has become turbulent. The carrier gas oxidant need not be provided in a stoichiometric amount. Some of the oxidant for combustion with the reagent could come from another source such as the oxidant provided for the establishment of the flame envelope.

Typically injector 3 would be located generally in the area of the furnace wall. Typically distance (d) would be in the range of from 20 to 100 nozzle diameters and typically the diameter of nozzle 4 is within the range of from 0.25 to 2 inches. The velocity of coherent gas jet 6 may be supersonic and generally is within the range of from 0.3 to 3.0 mach.

When the reagent is a gaseous reagent, for example methane or other gaseous hydrocarbon, the need to employ a carrier gas may be eliminated. In this case the reagent acts in the same way as does the carrier gas in the previously described embodiment. In this gaseous reagent embodiment, using the arrangement illustrated in the FIGURE, items 7 and 8 shown in the FIGURE are eliminated and the gaseous reagent acts as does item 1 of the FIGURE, all other aspects being the same.

With the practice of this invention one can effectively deliver reactive materials to specific locations such as in a boiler or furnace where the desired reactions take place. The invention enables a burner to operate such that the flame is some distance into the furnace to prevent wall overheating and maximize the desired heat transfer without creating additional pollutants or enhancing recirculation of flue gas to the boiler or furnace wall. Moreover, the invention enables one to intimately mix reagents with gas in the center of a reaction zone, such as a boiler, without significantly impacting the flow field of the bulk gas within the reaction zone. That is, one can mix reagent with the flue gas in the middle of a boiler without requiring large scale changes in the velocity or direction of the bulk gas in the boiler. This invention further allows the delivery of a reactive component at a specific point without consumption of that component that would be due to mixing before the jet reaches the desired reaction zone.

Although the invention has been described in detail with reference to particularly preferred embodiments, those skilled in the art will recognize that there are other embodiments of the invention within the spirit and the scope of the claims.

What is claimed is:

1. A method for providing a reagent to a reaction zone comprising:

(A) providing reagent to a carrier gas and passing reagent-containing carrier gas as a gas jet into an injection space from an injector through a distance (d);

(B) surrounding the gas jet with a flame envelope from the injector through the distance (d) so as to maintain the gas jet coherent through the distance (d);

(C) passing the reagent-containing carrier gas further into the injection space beyond the distance (d) into a reaction zone past the leading edge of the flame envelope as a non-coherent gas stream; and (D) providing reagent from the non-coherent gas stream to the reaction zone.

2. The method of claim 1 wherein the reagent is in liquid form.

3. The method of claim 1 wherein the reagent is in solid particulate form.

4. The method of claim 1 wherein the carrier gas is recirculated flue gas.

5. The method of claim 1 wherein the injector comprises a converging/diverging nozzle, the carrier gas is provided to the converging/diverging nozzle and the reagent is provided to the converging/diverging nozzle wherein it mixes with the carrier gas.

6. The method of claim 1 wherein the reaction zone contains NOx and further comprising reacting reagent with NOx within the reaction zone to form nitrogen gas.

7. The method of claim 1 wherein the reagent is fuel and the carrier gas is an oxidant, and the reagent and the carrier gas combust in the reaction zone.

8. The method of claim 7 wherein the reagent is powdered coal.

9. The method of claim 7 wherein the carrier gas is air.

10. A method for providing a reagent to a reaction zone comprising:

(A) passing gaseous reagent as a gas jet into an injection space from an injector through a distance (d);

(B) surrounding the gas jet with a flame envelope from the injector through the distance (d) so as to maintain the gas jet coherent through the distance (d);

(C) passing the gaseous reagent further into the injection space beyond the distance (d) into a reaction zone past the leading edge of the flame envelope as a non-coherent gas stream; and (D) providing gaseous reagent from the non-coherent gas stream to the reaction zone.

* * * * *